US005529220A

United States Patent [19]

Credle, Jr. et al.

[11] Patent Number: 5,529,220

[45] Date of Patent: Jun. 25, 1996

[54] BACKPACK BEVERAGE DISPENSER

[75] Inventors: William S. Credle, Jr., Stone Mountain; John Kuffner, Atlanta, both of Ga.

[73] Assignee: The Coca-Cola Company, Atlanta, Ga.

[21] Appl. No.: 361,262

[22] Filed: Dec. 21, 1994

[51] Int. Cl.[6] ..... B67D 5/64

[52] U.S. Cl. ..... 222/175; 222/136; 222/325; 222/399; 222/400.7; 222/400.8; 221/96

[58] Field of Search ..... 222/137, 175, 222/399, 401, 325, 400.7, 136, 400.8; 221/96

[56] References Cited

U.S. PATENT DOCUMENTS

| | | |
|---|---|---|
| D. 342,412 | 12/1993 | Ash, Jr. . |
| 1,406,158 | 2/1922 | Crane . |
| 2,018,543 | 10/1935 | Buirk . |
| 2,080,787 | 5/1937 | Rodgers . |
| 2,105,339 | 1/1938 | Sweitzer . |
| 2,558,181 | 6/1951 | Kassel . |
| 2,628,009 | 2/1953 | Idzi . |
| 2,684,787 | 7/1954 | Charpiat . |
| 2,732,977 | 1/1956 | Charpiat . |
| 2,994,421 | 8/1961 | Yingst et al. . |
| 3,240,395 | 3/1966 | Carver . |
| 3,286,884 | 11/1966 | Long, Jr. . |
| 3,527,391 | 9/1970 | Muria . |
| 3,825,154 | 7/1974 | Jaeger . |
| 3,868,049 | 2/1975 | Johnston . |
| 3,933,282 | 1/1976 | Stevens, Jr. . |
| 4,681,244 | 7/1987 | Giddie . |
| 4,869,402 | 9/1989 | Ash, Jr. . |
| 4,921,143 | 5/1990 | Billet . |
| 5,186,362 | 2/1993 | Biagi, Jr. . |
| 5,199,609 | 4/1993 | Ash, Jr. . |
| 5,385,275 | 1/1995 | Billet . |

FOREIGN PATENT DOCUMENTS

| | | |
|---|---|---|
| 181793 | 4/1955 | Austria . |

*Primary Examiner*—Gregory L. Huson
*Attorney, Agent, or Firm*—Thomas R. Boston

[57] ABSTRACT

An inexpensive, light weight backpack beverage dispenser using standard two-liter bottles to hold the premix beverage. The bottles are connected to a two-port cap and are then connected in series with $CO_2$ supplied to the inlet port of the first bottle and a dispensing hose and valve connected to the outlet port of the last bottle. The bottles, hoses and $CO_2$ cylinder are contained in a light, insulated pack provided with a shoulder harness.

15 Claims, 4 Drawing Sheets

BACKPACK BEVERAGE DISPENSER

BACKGROUND OF THE INVENTION

This invention relates to beverage dispensers and in a preferred embodiment to a backpack premix dispenser.

Backpack premix beverage dispensers are well-known. They are common at large sporting events and are useful any time when the consumer is not able to go to a stationary drink dispenser.

However, existing backpack dispensers are relatively expensive units built around special stainless steel tanks that hold the premix product. They are used with special filling equipment mounted near the site of the backpack dispensing area.

SUMMARY OF THE INVENTION

A portable, less expensive, lighter weight backpack dispenser which uses standard two-liter bottles to hold the premix product. The dispenser includes a pack, a harness, a $CO_2$ cylinder and a plurality of two-port caps connected to the bottles. Short beverage hoses connect the bottles in series, being connected from one cap outlet to the next cap inlet. The $CO_2$ cylinder is connected to the cap inlet port of the first bottle and the beverage dispensing hose is connected to the cap outlet port of the last bottle (in the series of bottles).

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
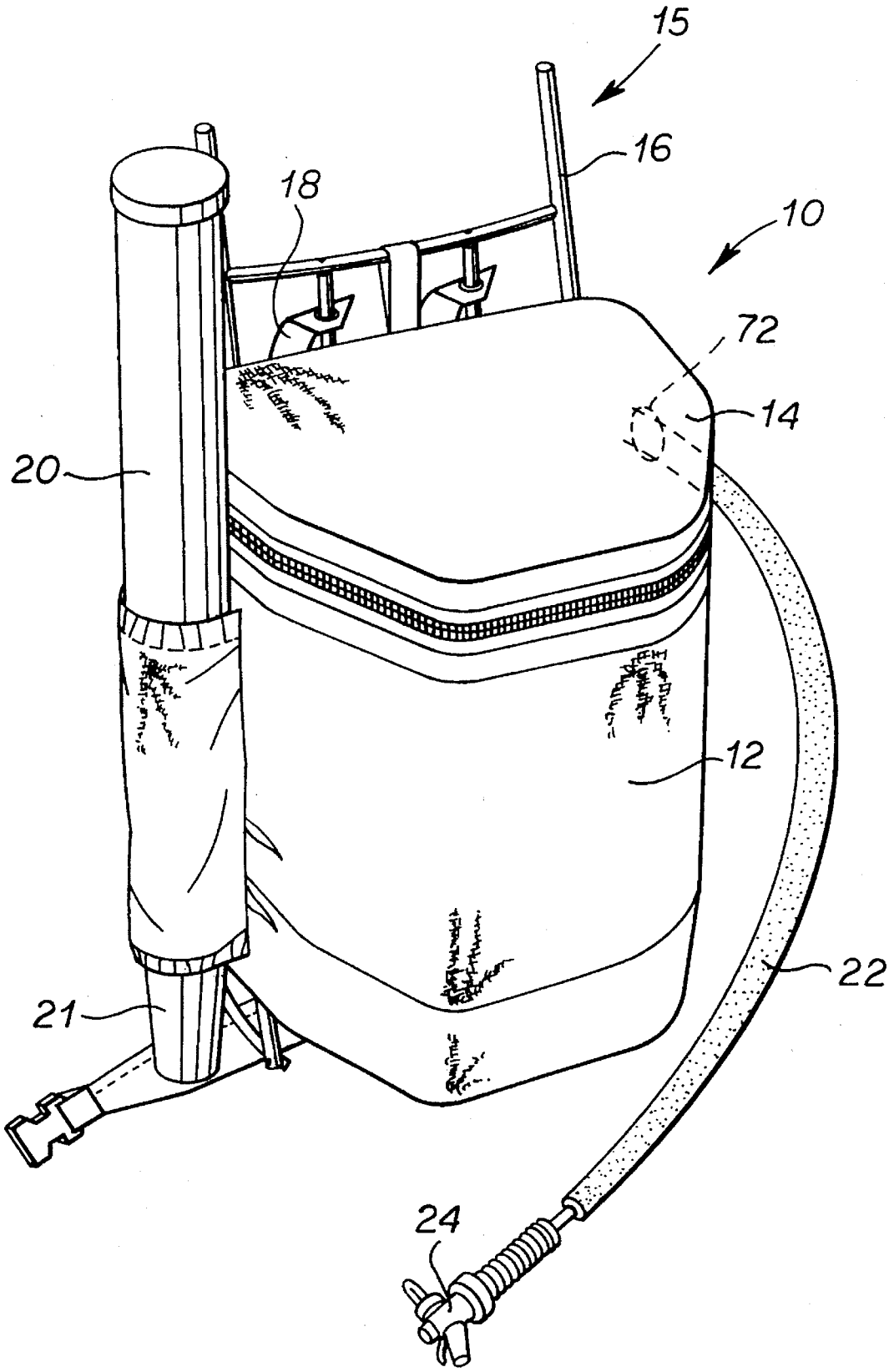
FIG. 1 is a perspective view of the outside of the preferred backpack dispenser of the present invention.

With reference now to the drawings, FIG. 1 shows a backpack dispenser 10 according to the preferred embodiment of this invention. The dispenser 10 includes a flexible, light weight, insulated pack 12 having a zippered lid 14 access panel, a support harness 15 preferably comprising a backpack frame 16 and straps 18, a cup carrier 20 for cups 21, and a dispensing hose 22 extending through a hole 72 in said pack 12 and having a dispensing valve 24.

Figure 2:
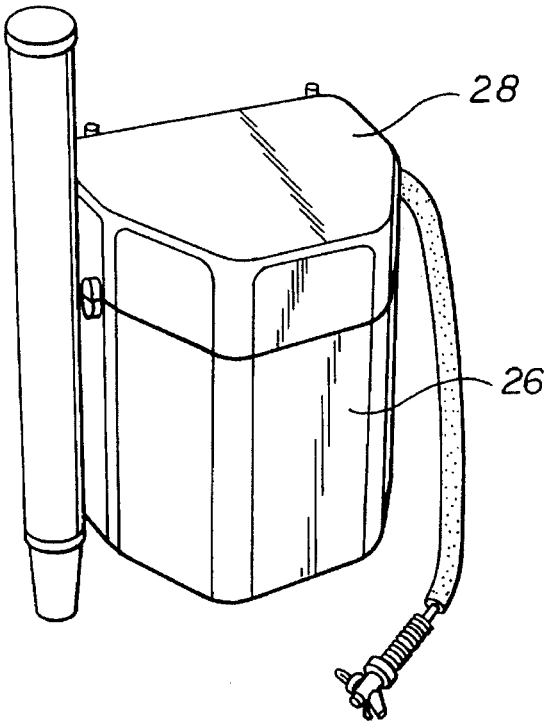
FIG. 2 is a perspective view of the outside of another embodiment of the backpack dispenser of this invention.
Figure 3:
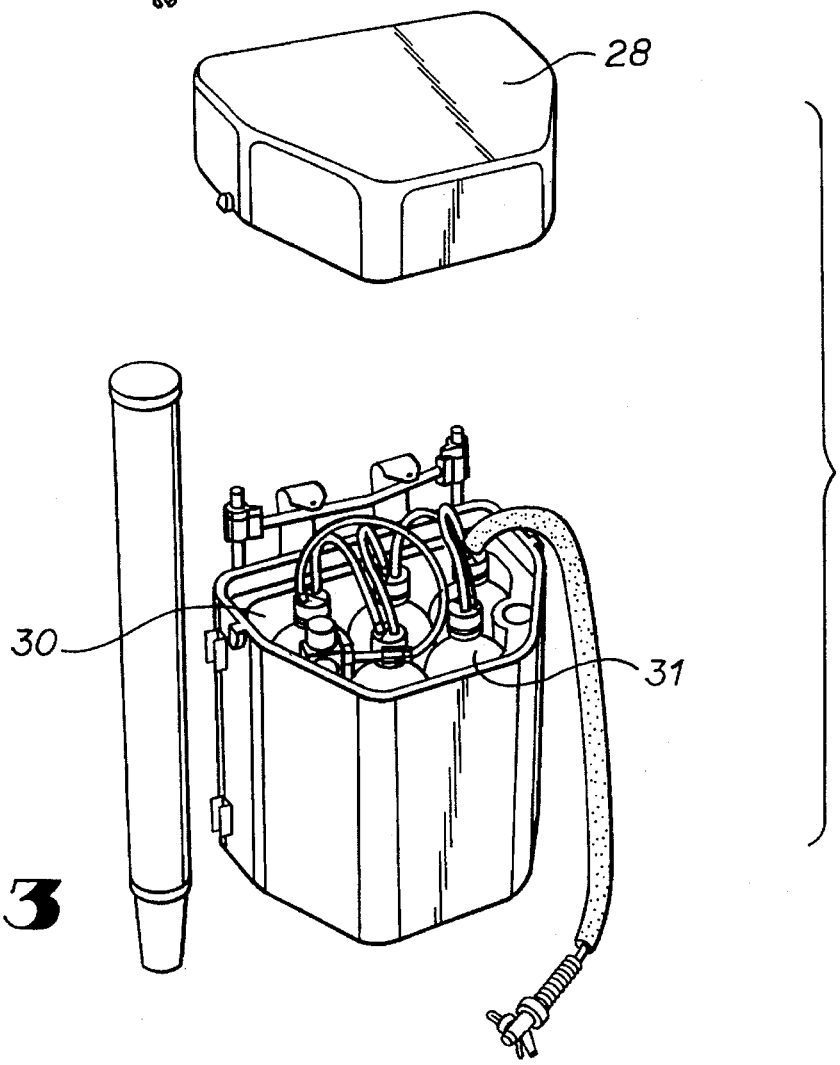
FIG. 3 is a perspective, partially exploded view of the dispenser of FIG. 2.

FIGS. 2 and 3 show an alternative pack 26 that is relatively rigid, made of plastic, having a removable lid 28 and enclosing a compartment 30. The preferred pack 12 has a similar compartment 30.

Figure 4:
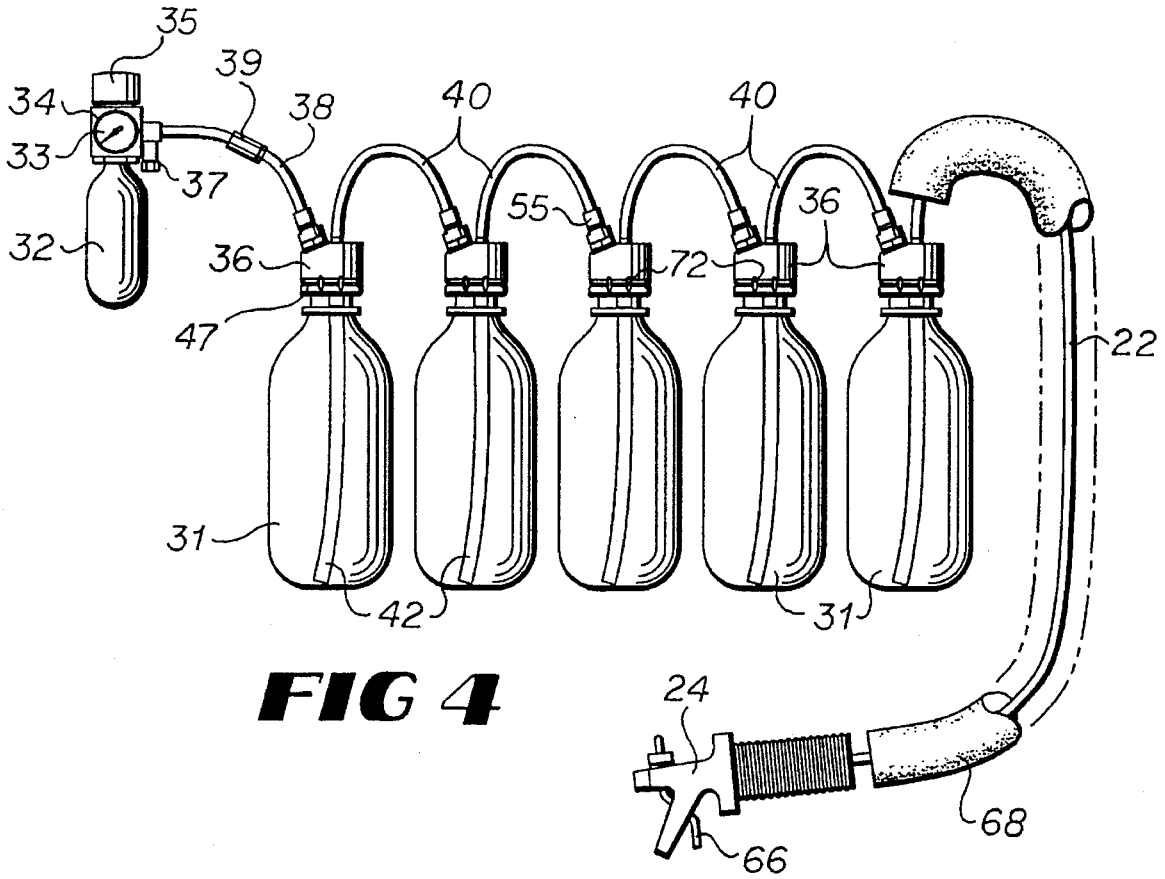
FIG. 4 is a diagrammatic view showing the fluid connection circuit of the dispenser of this invention.

A plurality (preferably five) of cold, standard bottles 31 (preferably two liter) of premix product are connected in series as shown in FIG. 4 and are placed inside the compartment 30 along with a gas pressurizing means which is preferably a $CO_2$ cylinder 32 as shown in FIG. 3.

Referring to FIG. 4, the backpack 10 includes the $CO_2$ cylinder 32, a pressure regulator 34, a plurality of two port caps 36, the dispensing hose 22, a $CO_2$ line 38, a plurality of beverage hoses 40, and a plurality of dip tubes 42.

The pressure regulator 34 can be any standard pressure regulator and includes a pressure gauge 33, a shut-off knob 35 and an automatic pressure relief valve 37. A check valve 39 is located in the $CO_2$ line 38 to prevent flow back toward the $CO_2$ cylinder.

Figure 5:
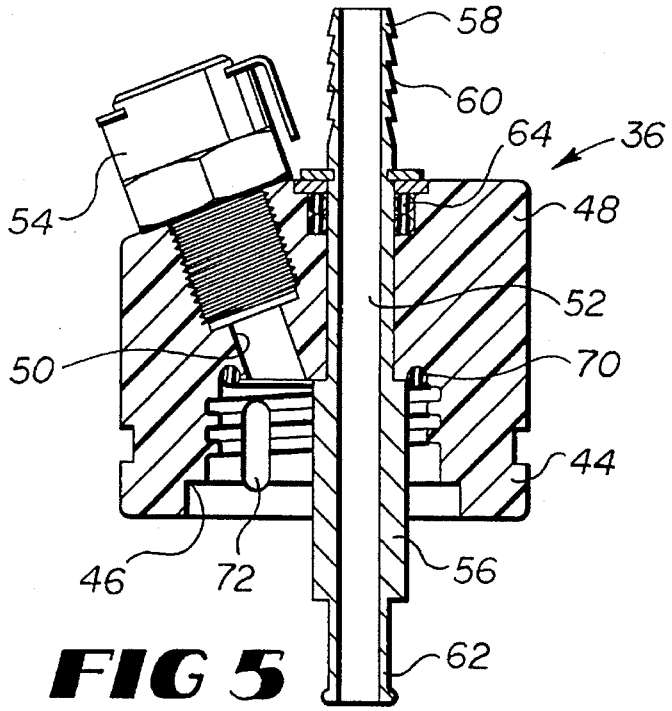
FIG. 5 is a cross-sectional view through the two-port bottle cap of this invention.

The two-port caps 36 are preferably identical and, as shown in FIG. 5, include a lower bottle coupling portion 44 having internal screw threads 46 that mate with the standard external bottle screw threads 47. The caps 36 also have an upper hose coupling portion 48 including an inlet port 50 and an outlet port 52. The inlet port 50 preferably has a quick disconnect coupling 54 for connecting to a beverage hose 40. The outlet port 52 preferably has a tubular fitting 56 sealingly connected therein and having a distal end 58 external of the cap 36 with a barbed hose fitting 60, and a proximal end 62 for receiving a replaceable dip tube 42 thereon.

The fitting 56 can rotate in the outlet port 52 and is sealed therein by O-ring 64. The inlet port 50 is angled so as to cause incoming beverage to flow down the outside of the dip tube to reduce foaming. By having the dip tube 42 be slightly curved and the fitting rotatable, the distal end of the dip tube can be moved to the lowest point in the bottle. The quick disconnect coupling 54 connects to a mating hose fitting 55. Any well-known standard type of quick disconnect coupling can be used. By virtue of this quick disconnect fitting, the individual empty bottles 31 can be quickly and individually removed from the compartment 30, unscrewed from the two-port cap 26, full bottles can then be connected to cap 36, placed in the compartment 30 and the hose 40 reconnected. When a bottle 31 is removed from the compartment, the short hose 40 comes out with it, being permanently connected to the outlet port of the cap 36.

An O-ring 70 seals the bottle 31 to the cup 36. One or more (preferably four ) vent holes 72 extend through the lower portion 44 of the cap 36 to vent any gas under pressure in the bottle 31 as the cap is unscrewed to relieve all the pressure prior to the screw threads becoming disengaged.

In operation, five cold bottles 31 are removed from a refrigeration compartment, their standard caps (not shown) are removed, and they are connected to the two port caps 36 and placed in the compartment 30. The $CO_2$ line 38 is connected to the inlet port of the cap 36 of the first bottle and the individual hoses 40 are connected to the inlet ports of the caps of the various bottles, thus hooking the bottles up in series. The dispensing hose 22 extends through a hole in the pack which can accommodate the valve 24. The $CO_2$ line 38 is then opened by turning on the knob 35 on the regulator 34 to set the predetermined desired pressure of about 20 psig and the lid 14 is then closed. Beverage can now be dispensed by pulling back on the finger actuated lever 66 of the dispensing valve 24.

The portion of the dispensing hose 22 outside of the pack 12 is preferably enclosed in an insulating sleeve 68. The dispenser 10 is preferably used as a backpack dispenser, but it can be used on a bicycle or cart, for example.

Figure 6:
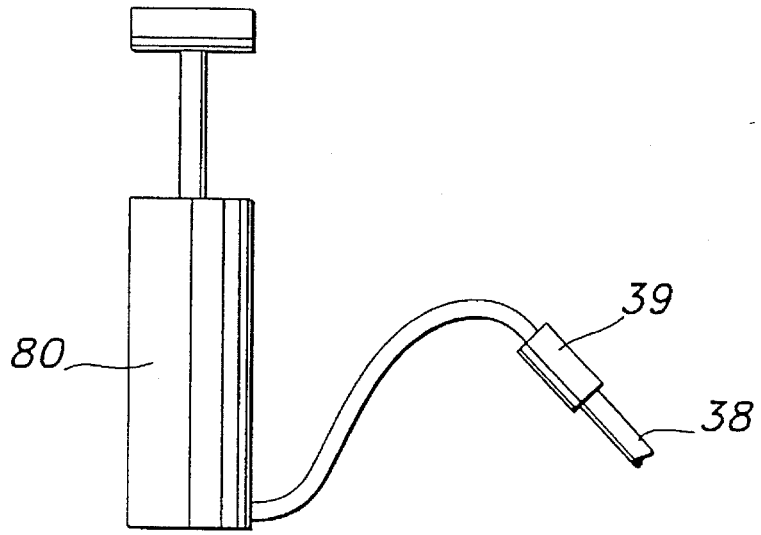
FIG. 6 is a diagrammatic view of another embodiment of the gas pressurizing means of this invention.

FIG. 6 shows another embodiment of the present invention wherein the gas pressurizing means connected to the gas line 38 is a manually operated air pump 80. The pump 80 can alternatively be battery operated.

Figure 7:
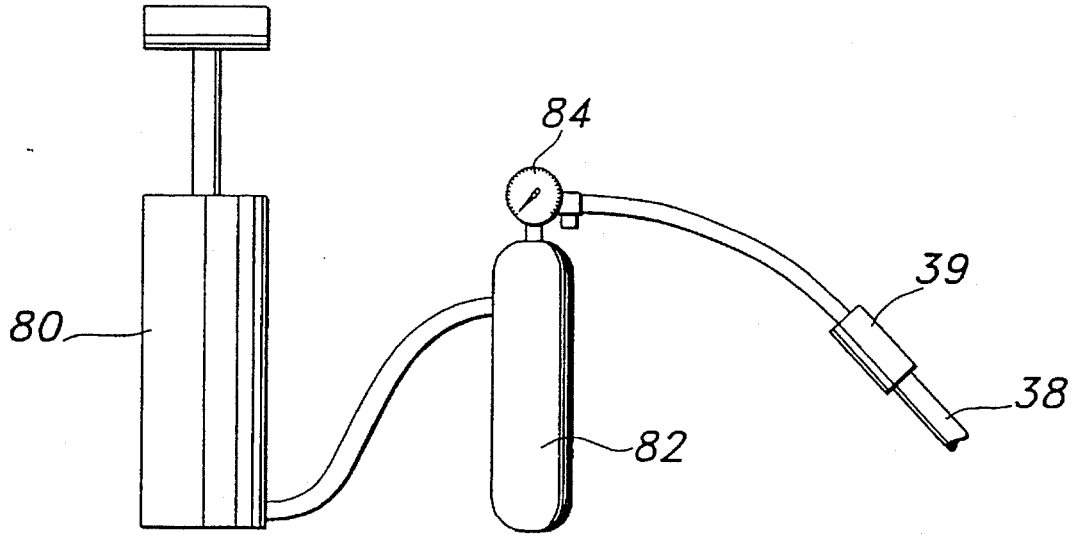
FIG. 7 is a diagrammatic view of a still further embodiment of this invention.

FIG. 7 shows a still further embodiment wherein the gas pressurizing means connected to the gas line 38 is the pump 80 of FIG. 6 plus a pressurizable air tank 82 having a pressure regulator and gauge 84. The pump can be kept in the pack or can be kept separate therefrom.

While the preferred embodiment of this invention has been described above in detail, it is to be understood that variations and modifications can be made therein without departing from the spirit and scope of the present invention. It is to be understood that other numbers of bottles than five can be used and other sizes than two liter. It is not essential that one of the two ports on the cap 36 be a quick-disconnect; it could be permanent. The cup carrier need not be connected to the pack. The harness need not be a shoulder harness; it could connect just at the waist or to a bicycle. Two series of bottles of different product can be used. The outlet port need not have a swivel tube therein. A pressure vent could be provided in the hoses or cap rather than be an automatic part of the cap 36. If desired, both of the cap fittings can be quick disconnect fittings.

What is claimed is:

1. A portable beverage dispenser pack for use with standard bottles of premix product comprising:

(a) an insulated pack having an internal compartment and an access panel for providing access to said compartment;

(b) gas pressurizing means and a gas line located in said compartment;

(c) a plurality of two-port bottle caps connected in series by a plurality of beverage hoses, each of said caps including:

(i) a lower bottle coupling portion having an internal screw thread for attachment to the external screw threads on a standard bottle of premix product;

(ii) an inlet port in an upper hose coupling portion of said cap and a hose fitting connected to said inlet port;

(iii) an outlet port in said upper portion of said cap separate from said inlet port, a hose fitting connected to the distal end of said outlet port and a dip tube fitting connected to the proximal end of said outlet port;

(d) a dip tube connected to each of said dip tube fittings;

(e) said beverage hoses connecting said caps in series being connected between an outlet port of an upstream cap and an inlet port of the next succeeding downstream cap;

(f) said gas line being connected between said gas pressurizing means and the first cap in said series of caps;

(g) a dispensing hose opening in said pack;

(h) a dispensing hose connected to the outlet port of the last cap in said series of caps and extending through said hose opening in said pack and exteriorly of said pack; and (i) a manually operable dispensing valve on the distal end of said dispensing hose for dispensing beverage therefrom.

2. The dispenser as recited in claim 1 wherein said inlet port extends at an angle to said outlet port and directs incoming liquid directly onto the outside of said dip tube to reduce foaming.

3. The dispenser as recited in claim 2 wherein at least one of said hose fittings of said cap is a quick disconnect fitting.

4. The dispenser as recited in claim 3 wherein said cap includes at least one vent hole completely therethrough in the location of said internal screw threads for relieving gas pressure from a bottle during unscrewing of the cap therefrom.

5. The dispenser as recited in claim 4 including a tubular fitting sealingly connected in said outlet port and having a distal end external to said cap with said hose fitting thereon and having a proximal end with said dip tube fitting thereon.

6. The dispenser as recited in claim 1 wherein said gas pressurizing means is a $CO_2$ cylinder and regulator.

7. The dispenser as recited in claim 1 wherein said gas pressurizing means is an air pump.

8. The dispenser as recited in claim 7 wherein said gas pressurizing means includes an air tank and gauge connected to said pump.

9. The dispenser as recited in claim 1 including a harness means connected to said pack for supporting said pack.

10. The dispenser as recited in claim 9 wherein said harness means includes a backpack frame for supporting said pack on a person.

11. The dispenser as recited in claim 1 including a plurality of standard premix bottles connected one each to said caps.

12. The dispenser as recited in claim 1 wherein said inlet port hose fitting of said cap is a quick disconnect fitting.

13. The dispenser as recited in claim 1 including a tubular fitting sealingly connected in said outlet port and having a distal end external to said cap with said hose fitting thereon and having a proximal end with said dip tube fitting thereon.

14. The dispenser as recited in claim 13 wherein said tubular fitting is rotatably mounted in said outlet port.

15. The dispenser as recited in claim 1 wherein said cap includes at least one vent hole completely therethrough in the location of said internal screw threads for relieving gas pressure from a bottle during unscrewing of the cap therefrom.

* * * * *